United States Patent [19]

Nakamura et al.

[11] Patent Number: 4,669,442

[45] Date of Patent: Jun. 2, 1987

[54] EXHAUST GAS RECIRCULATION APPARATUS FOR ENGINE WITH TURBOCHARGER

[75] Inventors: Hiroshi Nakamura; Shirou Matsuo; Noriaki Kawai, all of Toyota, Japan

[73] Assignee: Toyota Jidosha Kabushiki Kaisha, Aichi, Japan

[21] Appl. No.: 738,235

[22] Filed: May 28, 1985

[30] Foreign Application Priority Data

Jun. 6, 1984 [JP] Japan ..... 59-83835[U]

[51] Int. Cl.[4] ..... F02M 25/06

[52] U.S. Cl. ..... 123/571; 123/568

[58] Field of Search ..... 123/569, 571, 568; 60/605

[56] References Cited

U.S. PATENT DOCUMENTS

| | | | |
|---|---|---|---|
| 4,349,004 | 9/1982 | Matsuda | 123/569 |
| 4,369,753 | 1/1983 | Sugiyama | 123/569 |
| 4,399,799 | 8/1983 | Romblom et al. | 123/569 |
| 4,450,825 | 5/1984 | Sekiguchi et al. | 123/571 X |
| 4,474,161 | 10/1984 | Knapp et al. | 60/605 X |

FOREIGN PATENT DOCUMENTS

| | | | |
|---|---|---|---|
| 0129747 | 10/1981 | Japan . | |
| 0157046 | 9/1982 | Japan | 123/569 |
| 0210157 | 12/1982 | Japan | 123/569 |

*Primary Examiner*—Willis R. Wolfe, Jr.

*Attorney, Agent, or Firm*—Parkhurst & Oliff

[57] ABSTRACT

An exhaust gas recirculation controlling apparatus suitable for an engine wth a turbocharger. An EGR valve which is provided in an EGR passage connecting an exhaust system passage and an intake system passage of the engine controls the amount of EGR. A vacuum adjustment valve controls the vacuum supplied from a vacuum source to the EGR valve. A valve device for cutting off the supply of vacuum in a vacuum range which is lower than the vacuum corresponding to at least the lower limitation value in the EGR controlling range with respect to the vacuum controlling characteristics of a vacuum adjustment valve is provided in the passage connecting the EGR valve and the vacuum adjustment valve such as to securely close the EGR valve when the running state of the engine is out of the EGR controlling range.

6 Claims, 5 Drawing Figures

EXHAUST GAS RECIRCULATION APPARATUS FOR ENGINE WITH TURBOCHARGER

BACKGROUND OF THE INVENTION

1. Field of the Invention

This invention relates to an exhaust gas recirculation apparatus, and more particularly, to an exhaust gas recirculation apparatus suitable for an engine with a turbocharger.

2. Description of the Related Art

It is necessary to reduce the amount of carbon monoxide CO, hydrocarbon HC, and nitrogen oxide NOx contained in exhaust gases from vehicles such as an automobile. It is known that among these poisonous gases, nitrogen oxide NOx can be reduced by mixing inactive gases contained in exhaust gases such as $H_2O$, $N_2$, and $CO_2$ into the combustion mixture and lowering the maximum combustion temperature by virtue of the heat capacity of the inactive gases. With this fact in mind, in order to reduce nitrogen oxide, an exhaust gas recirculation (hereinunder referred to as "EGR") apparatus which recirculates exhaust gas to an intake system is provided in various kinds of vehicles.

Of these apparatus, in an engine with a turbocharger there is an apparatus in which a bypass pipeline for connecting an exhaust line on the upstream side of an exhaust turbine and an intake line on the downstream side of a compressor is provided as a passage for recirculating exhaust gas, namely an EGR passage, and midway in the EGR passage is provided a valve body for opening and closing the EGR passage in correspondence with the urging force of a diaphragm, namely an EGR valve. In this apparatus, when the engine is in a running state in which exhaust gas recirculation control is necessary, namely when the running state of the engine is in an EGR control range, a vacuum pressure from a vacuum source which sucks the diaphragm of the EGR valve is introduced to a diaphragm chamber, and the EGR valve is opened to open the EGR passage, whereby the exhaust gas is recirculated to the intake system. Except when the engine is in the EGR control range, the EGR valve is closed by the urging force of the diaphragm and the EGR passage is closed.

When an engine is in a high-speed and high-load state, the exhaust gas pressure increases with the increase of the load. On the other hand, in this kind of engine with a turbocharger, in order to keep boost pressure constant, when the boost pressure is beyond a predetermined pressure, exhaust gas is released to a passage detouring the turbine of the turbocharger. As a result, even if exhaust gas pressure becomes high, the boost pressure, namely intake pressure does not exceed a predetermined value. Therefore, the difference of the pressure between the intake side of the EGR passage which connects the intake system passage with the exhaust system passage and the exhaust side thereof becomes large. Furthermore, a vacuum adjustment valve is connected to the EGR valve which is provided in the EGR passage for the purpose of controlling the amount of EGR. This vacuum adjustment valve supplies a vacuum from a vacuum source after controlling it in accordance with the electric current supplied from a controller. However, due to its inherent structure, the vacuum leaks even when the current value is zero, and this leaked vacuum is transferred to the EGR valve as a residual pressure.

Therefore, the conventional EGR apparatus has the deficiencies or problems that the pressure difference between the intake system passage side and the exhaust system passage side is large even if the EGR passage is closed by the EGR valve in the high-speed and high-load range, which is out of the EGR controlling range, and that the EGR valve is inadvertently slightly opened due to the residual pressure of the vacuum adjustment valve and exhaust gas flows to the intake system passage side, whereby the power of the engine is lowered or black smoke is generated.

SUMMARY OF THE INVENTION

Accordingly it is an object of the invention to provide an EGR controlling apparatus for an engine with a turbocharger which can securely close the EGR valve and, hence, the EGR passage when the running state of the engine is out of the EGR controlling range, and can thereby prevent exhaust gas from accidentally leaking to the intake system passage side.

To achieve this aim, this invention provides an EGR controlling apparatus for an engine with a turbocharger comprising: an EGR valve which is provided in an EGR passage connecting an exhaust system passage and an intake system passage of the engine for the purpose of controlling the amount of EGR; a vacuum adjustment valve for controlling the vacuum supplied from a vacuum source to the EGR valve; and a valve device for cutting off the supply of vacuum in the vacuum range which is lower than the vacuum corresponding to at least the lower limitation value in the EGR controlling range with respect to the vacuum controlling characteristics of a vacuum adjustment valve, this valve device being provided in the passage connecting the EGR valve and the vacuum adjustment valve such as to securely close the EGR valve when the running state of the engine is out of the EGR controlling range.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
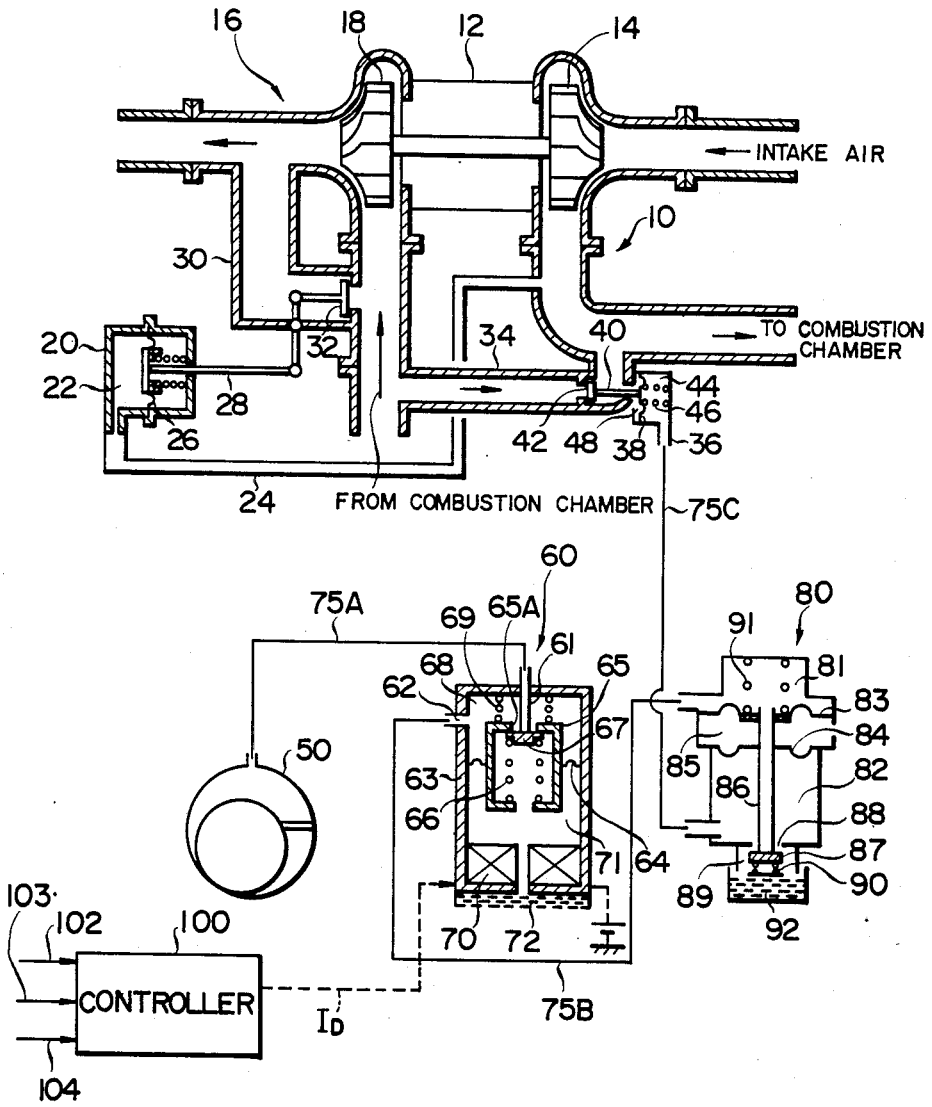
FIG. 1 shows the structure of an embodiment of an EGR controlling apparatus according to the invention.

Referring first to FIG. 1 showing the structure of an embodiment of an EGR controlling apparatus according to this invention, a compressor 14 of a turbocharger 12 is provided in an intake air passage 10 of an engine and an exhaust turbine 18 of the turbocharger 12 in an exhaust air passage 16 such that the intake air pressurized by the turbocharger 12 is supplied to a combustion chamber. An actuator 20 is provided for the purpose of suppressing the boost pressure of the intake air to a predetermined value. To a diaphragm chamber 22 of the actuator 20, the intake air on the downstream side of the compressor 14 is introduced through a pipe line 24, and a rod 28 connected to a diaphragm 26 is connected to a waste gate valve 32 provided to close a bypass pipe 30 which functions to bypass the upstream side and the downstream side of the exhaust turbine 18. By these means, when the boost pressure of the downstream side of the compressor 14 exceeds a preset level, the actuator 20 is activated to open the waste gate valve 32. Then the exhaust gas on the upstream side of the exhaust turbine 18 is bypassed to the downstream side, and the driving force of the turbocharger 12 is reduced, thereby preventing the boost pressure from exceeding the preset level.

In order to recirculate exhaust gas, an EGR passage 34 is provided which connects the exhaust air passage 16 at the upstream side of the exhaust turbine 18 and the intake air passage 10 at the downstream side of the compressor 14. In the EGR passage 34 is provided an EGR valve 36 for controlling the amount of EGR, which is composed of a diaphragm 38 for defining a diaphragm chamber 44 into which vacuum is introduced, a rod 40 one end of which is secured to the diaphragm 38 and which has a valve body 42 at the other end, and a spring 46 for constantly urging the valve body 42 in the lefthand direction, as viewed in FIG. 1. The valve body 42 of the EGR valve 36 ordinarily closes, by the urging force of the spring 46, the EGR passage 34 which connects the intake air passage 10 and the exhaust air passage 16. Referential numeral 50 denotes a vacuum source for supplying vacuum to the diaphragm chamber 44 of the EGR valve 36, and this vacuum source 50 is connected by a passage 75 to the diaphragm chamber 44 of the EGR valve 36 through a vacuum adjustment valve 60 and a valve device 80.

To describe the apparatus in more detail, the vacuum adjustment valve 60 is substantially composed of a housing 63, a diaphragm chamber 68 into which vacuum is introduced, an atmospheric air chamber 71 which is communicated to atmospheric air, both chambers 68 and 71 being formed in the housing 63 by the division of it into two parts, and a movable valve 65 for controlling the communication of both chambers 68 and 71. In the diaphragm chamber 68 are provided a vacuum introducing passage 61 which is communicated to the vacuum source 50 through a passage 75A and an outlet 62 which is communicated to the vacuum control valve 80 through a passage 75B. The movable valve 65 has a communicating hole 65A, for communicating both chambers 68 and 71, and a valve body 67 for opening and closing the communicating hole 65A, and it is supported as a whole in the housing 63 by the diaphragm 64 which forms a partition between the chamber 68 and the chamber 71. The movable valve 65 is urged by a spring 69 on the upper wall in the direction in which the communicating hole 65A is closed in combination with the valve body 67, and the valve body 67 is urged by a spring 66 in the movable valve 65 in a direction in which the communicating hole 65A is closed. An excitation coil 70 for opening the valve body 67 against the resistance of the spring 66 is provided in the atmospheric chamber 71 and it is electrically connected to a controller 100 which is provided separately from the vacuum adjustment valve 60. The controller 100 fetches a signal showing the running state of the engine, such as an engine rotational speed signal 102, engine load signal 103 and engine coolant temperature signal 104, and on the basis of these signals outputs a driving current $I_D$ to the exciting coil 70 of the vacuum control valve 60. In correspondence with the driving current $I_D$, the vacuum adjustment valve 60 controls the vacuum which is to be introduced into the EGR valve 36, whereby the amount of EGR which corresponds with the running state of the engine is obtained.

Referential numeral 72 represents a filter, through which air is introduced to the atmospheric chamber 71.

Figure 2:
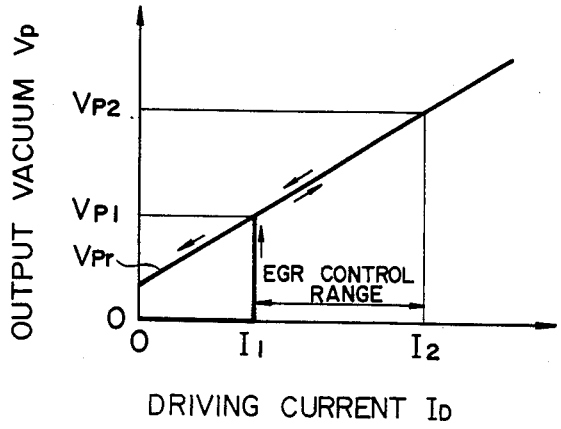
FIG. 2 shows the vacuum controlling characteristics of a vacuum adjustment valve 60.

FIG. 2 schematically shows the relationship between the driving current $I_D$ the output vacuum Vp of the vacuum adjustment valve 60. As is obvious from this Figure, the driving current $I_1$ which accords with the EGR control range is supplied from the controller 100 to the vacuum adjustment valve 60, whereby the vacuum adjustment valve 60 outputs the vacuum $Vp_1$ for EGR control. The output vacuum Vp increases with increase of the driving current $I_D$ and the range defined by the driving current $I_1$ to $I_2$ and the output vacuum $Vp_1$ to $Vp_2$ is determined to be the EGR control range. The vacuum which is indicated by symbol $V_{pr}$ is the residual pressure which is output even when the running state of the engine is out of the EGR control range and the driving current is 0 ampere.

A vacuum control valve 80 has a vacuum receiving chamber 81 which is connected to the outlet 62 of the vacuum adjustment valve 60 through the passage 75B, and a vacuum control chamber 82 which is connected to the diaphragm chamber 44 of the EGR valve 36 through a passage 75C. The vacuum receiving chamber 81 and the vacuum control chamber 82 are compartmented respectively by first and second diaphragms 83 and 84, and between the two diaphragms 83 and 84 is formed an atmospheric air chamber 85. The vacuum receiving chamber 81 is able to communicate to the vacuum control chamber 82 through a pipeline 86, which is secured to the first diaphragm 83, penetrates through the atmospheric air chamber 85 and the second diaphragm and extends to the vacuum control chamber 82. In the state shown in FIG. 1, however, an opening 88 at the lower end of the pipe line 86 is closed in contact with a valve body 87 and vacuum is not introduced into the vacuum control chamber 82. The valve body 87 is disposed in a second atmospheric air chamber 89 which is communicated to the vacuum control chamber 82 through the opening 88 and is urged by a spring 90 in such a direction as to close the opening 88. The first diaphragm 83 is urged by a spring 91 downwardly as viewed in FIG. 1, and, hence, the pipeline 86 which is secured to the first diaphragm 83 is also urged downwardly as seen in FIG. 1 against the resistance of valve body 87. The second atmospheric chamber 89 is communicated to atmospheric air through a filter 92. In the state shown in the Figure, atmospheric air is introduced to the vacuum control chamber 82, and the atmospheric air is introduced to the EGR valve 36. When vacuum against the resistance of spring 91 is introduced into the vacuum receiving chamber 81 from the vacuum adjustment valve 60, the first diaphragm 83 and, hence, the pipeline 86 are elevated, and the valve body 87 closes the opening 88 by means of the urging force of the spring 90, whereby the vacuum receiving chamber 81 and the vacuum control chamber 82 are communicated and the vacuum from the vacuum adjustment valve 60 is directly introduced to the EGR valve 36.

Figure 3:
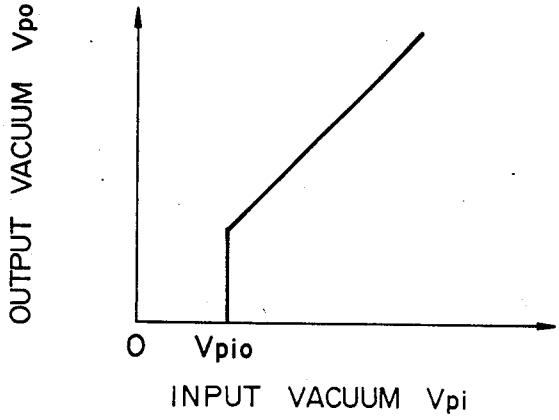
FIG. 3 shows the performance characteristics of a valve device 80.

FIG. 3 shows the performance characteristics of the vacuum control valve 80. The input vacuum $V_{pi}$ and the output vacuum $V_{p0}$ take the same value, but when the input vacuum is under $V_{pi0}$, no vacuum is output or, to be more exact, atmospheric air is output. The effective lower limitation value $V_{pi0}$ is set to be lower than the lower limitation value $V_{p1}$ of the vacuum controlling characteristics of the vacuum adjustment value 60 in the EGR control region shown in FIG. 2. This is for the purpose of providing a hysteresis for safely executing the EGR control in the EGR control region.

Figure 4:
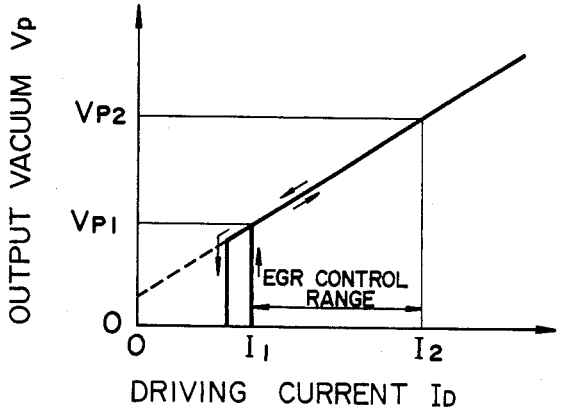
FIG. 4 shows the vacuum controlling characteristics obtained by this embodiment in which the vacuum adjustment valve 60 and the valve device 80 are arranged in series.

FIG. 4 shows the vacuum controlling characteristics of the embodiment in which the vacuum adjustment valve 60 and the vacuum control valve 80 are connected in series. As is obvious from FIG. 4, when the running state of the engine is in the EGR control range, the constant vacuum from the vacuum source 50 is controlled by the vacuum adjustment valve 60 in correspondence with the amount of the driving current which is output from the controller 100 to the vacuum adjustment valve 60, and the controlled vacuum is supplied to the EGR valve 36 through the vacuum control valve 80, whereby the EGR valve 36 is controlled such as to have a predetermined divergence, in other words, to have a predetermined amount of EGR.

When the running state of the engine is out of the EGR control range, a drive current $I_D$ is not output from the controller 100 to the vacuum adjustment valve 60. However, as described above, the vacuum adjustment valve 60 supplies the residual pressure from the outlet 62 to the passage 75B due to the form of its structure. If the residual pressure is controlled by the vacuum control valve 80 such as to have a value under the vacuum $V_{pi0}$, which is slightly smaller than the lower limitation value in the EGR control range, the residual pressure is safely cut off and the EGR valve is closed. Therefore, sufficient EGR control is maintained in the predetermined EGR control range, and outside it exhaust gas is prevented from leaking accidentally to the intake system passage side.

Figure 5:
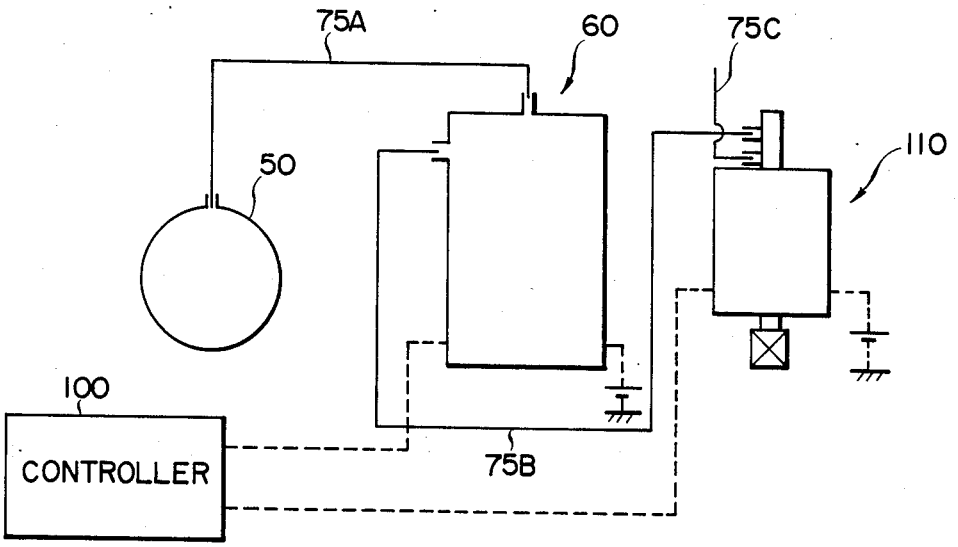
FIG. 5 shows another embodiment of the invention.

Referring to FIG. 5 which shows another embodiment of this invention, the vacuum control valve in the first embodiment is replaced by a vacuum switching valve 110. Since the structure and action of other members are completely the same as those of the first embodiment, no explanation of them will be given. The vacuum switching valve 110 is electrically connected to the controller 100 in parallel with the vacuum adjustment valve 60, receives a signal from the controller 100 based on the running state of the engine and acts in approximately the same way as the performance characteristics of the vacuum control valve 80. That is, when the running state of the engine is in the EGR control range, the vacuum output from the vacuum adjustment valve 60 is introduced directly to the EGR valve 36, and when out of the EGR control range, the residual pressure from the vacuum adjustment valve 60 is cut off and safely prevents the EGR valve from opening.

While there have been described what are at present considered to be the preferred embodiments of the invention, it will be understood that various modifications may be made therein, and it is intended that the appended claims cover all such modifications as fall within the true spirit and scope of the invention.

What is claimed is:

1. An exhaust gas recirculation apparatus for an internal combustion engine having an intake air passage and an exhaust gas passage connected thereto, said apparatus comprising:

an exhuast gas recirculation passage connecting the exhaust gas passage to the intake air passage for recirculating the exhaust gas into the intake air passage;

a vacuum-operated exhaust gas recirculation control valve disposed in said exhaust gas recirculation passage for controlling the flow of the exhaust gas to be recirculated, said exhaust gas recirculation control valve comprising a diaphragm for receiving admitted operating vacuum such that the valve closes when the absolute value of the admitted operating vacuum is lower than the absolute value of a first predetermined vacuum value and opens when the absolute value of the admitted operating vacuum is higher than the absolute value of said first Predetermined vacuum value;

a vacuum source and a vacuum line connecting said vacuum source to said exhaust gas recirculation control valve to admit the operating vacuum therefor;

a pressure regulating valve disposed in said vacuum line between said vacuum source and said exhaust gas recirculation control valve for regulating a source vacuum to create the operating vacuum for said exhaust gas recirculation control valve depending on the driving condition of the engine such that the absolute value of said operating vacuum is higher than the absolute value of said first predetermined vacuum value when the driving condition of the engine is in a predetermined range so as to operate said exhaust gas recirculation control valve; and a low pressure cut-off valve disposed in said vacuum line between said pressure regulating valve and said exhaust gas recirculation control valve and comprising a housing, first and second diaphragms for dividing the housing into first, second and third chambers, a pipe secured to the first diaphragm and extending through the second diaphragm into the third chamber so as to allow fluid communication between the first and third chambers, an inlet opening adapted to communicate the first chamber with the pressure regulating valve, an outlet opening adapted to communicate the third chamber with the exhaust gas recirculation control valve, an air opening adapted to communicate the second chamber with the atmosphere, a further air opening adapted to communicate the third chamber with the atmosphere, a valve seat arranged in said further opening, and a valve element selectively engaging one or said pipe and said valve seat for transmitting the operating vacuum from said pressure regulating valve to said exhaust gas recirculation control valve when the absolute value of the vacuum in the first chamber is higher than the absolute value of a second predetermined vacuum value, which is lower than the absolute value of said first predetermined vacuum value, and for cutting off the operating vacuum from said pressure regulating valve to said exhaust gas recirculation control valve when the absolute value of the vacuum in the first chamber is lower than the absolute value of said second predetermined vacuum value, whereby said exhaust gas recirculation control valve is Prevented from being accidentally opened by a residual vacuum which prevails in said pressure regulating valve when the driving condition of the engine is out of said predetermined range.

2. An exhaust gas recirculation apparatus as set forth in claim 1, wherein said low pressure cut-off valve cuts off said operating vacuum and transmits an atmospheric pressure to said exhaust gas recirculation control valve when the absolute value of the vacuum in the first chamber is lower than the absolute value of said second predetermined vacuum value.

3. An exhaust gas recirculation apparatus as set forth in claim 1, further comprising:

a bypass passage connecting an upstream side of said exhaust turbine and a downstreamside of said exhaust turbine; and a waste gate valve interposed in said bypass passage to allow said exhaust air to bypass said exhaust turbine when the intake air at a downstream side of said compressor has a pressure greater than a predetermined pressure.

4. An exhaust gas recirculation apparatus as set forth in claim 1, wherein the second chamber of the low pressure cut-off valve is disposed between the first and third chambers, the first diaphragm is disposed between the first and second chambers, and the second diaphragm is disposed between the second and third chambers.

5. An exhaust gas recirculation apparatus as set forth in claim 1, further comprising control means for receiving signals representative of the driving condition of the engine and outputting a controlled current to the pressure regulating valve when the driving condition is within said predetermined range so as to regulate the level of operating vacuum to be admitted to said exhaust gas recirculation valve.

6. An exhaust gas recirculation apparatus as set forth in claim 5, wherein said signals representative of the driving condition of the engine received by said control means include signals of an engine rotational speed, an engine coolant temperature and an engine load.

* * * * *